US010371014B2

(12) United States Patent
Wickham

(10) Patent No.: US 10,371,014 B2
(45) Date of Patent: Aug. 6, 2019

(54) STEAM CYCLE POWER MODULE

(71) Applicant: Heat Recovery Solutions Limited, London (GB)

(72) Inventor: Mark Wickham, London (GB)

(73) Assignee: Heat Recovery Solutions Limited, London (GB)

( * ) Notice: Subject to any disclaimer, the term of this patent is extended or adjusted under 35 U.S.C. 154(b) by 92 days.

(21) Appl. No.: 15/312,725

(22) PCT Filed: May 20, 2015

(86) PCT No.: PCT/GB2015/051481
§ 371 (c)(1),
(2) Date: Nov. 21, 2016

(87) PCT Pub. No.: WO2015/177543
PCT Pub. Date: Nov. 26, 2015

(65) Prior Publication Data

US 2017/0191383 A1 Jul. 6, 2017

(30) Foreign Application Priority Data

May 20, 2014 (GB) ..... 1408960.1

(51) Int. Cl.
*F01K 13/00* (2006.01)

(52) U.S. Cl.
CPC ..... *F01K 13/00* (2013.01)

(58) Field of Classification Search
CPC . F01K 13/00; F01K 7/16; F01K 17/00; F01D 15/10; F01D 17/14; F28D 15/0233; F28D 15/0266
See application file for complete search history.

(56) References Cited

U.S. PATENT DOCUMENTS 3,363,885 A * 1/1968 Meek ..... F28C 1/04 261/111
5,067,560 A * 11/1991 Carey ..... F25B 39/04 165/122

(Continued)

FOREIGN PATENT DOCUMENTS

| | | |
|---|---|---|
| EP | 2148048 | 1/2010 |
| JP | 2001139963 | 5/2001 |
| WO | 03/072384 | 9/2003 |

OTHER PUBLICATIONS

PCT International Search Report; international application No. PCT/GB2015/051481; international filing date May 20, 2015; five pages.

(Continued)

*Primary Examiner* — Mark A Laurenzi
*Assistant Examiner* — Shafiq Mian
(74) *Attorney, Agent, or Firm* — Boyle Fredrickson, S.C.

(57) ABSTRACT

An integrated steam cycle power module (100) comprising a steam turbine (102) arranged to have steam supplied thereto; a steam manifold (104) arranged to have exhaust steam from the steam turbine supplied thereto; at least one heat exchanger (108) arranged to have exhaust steam supplied thereto from the manifold via risers which connect the manifold to headers (117) associated with the heat exchangers; and having the steam turbine situated below the steam manifold and arranged, in use, to vent exhaust steam to the manifold, which exhaust steam is passed to the heat exchanger in order to have heat extracted therefrom. Substantially all of the equipment required can be integrated into a compact module reducing plot space, overall costs and assembly time on site or allowing the module to be fabri- (Continued)

cated off site. The heat exchanger may be arranged to form substantially planar, substantially vertical walls along the side regions of the module.

13 Claims, 5 Drawing Sheets

(56) References Cited

U.S. PATENT DOCUMENTS 6,422,018 B1* 7/2002 Tisdale ..... F02C 7/04 60/728
2003/0033994 A1* 2/2003 Campion ..... F02B 63/04 123/41.56
2003/0116308 A1* 6/2003 Watanabe ..... F28D 1/05366 165/144
2004/0104577 A1* 6/2004 Alger ..... F02B 63/04 290/1 A
2005/0252235 A1* 11/2005 Critoph ..... F25B 17/00 62/480
2007/0101717 A1* 5/2007 Beaulieu ..... F01K 13/00 60/645
2008/0034776 A1* 2/2008 Jensen ..... F24F 1/027 62/305
2010/0006270 A1* 1/2010 Vouche ..... F28B 1/06 165/110
2010/0050638 A1* 3/2010 Ogino ..... F01D 15/10 60/670
2010/0199714 A1* 8/2010 Yanik ..... F25B 39/04 62/507

OTHER PUBLICATIONS

Search Report issued by the Intellectual Property Office dated Nov. 26, 2014 re GB1408960.1; three pages.

* cited by examiner

STEAM CYCLE POWER MODULE

CROSS REFERENCE TO RELATED APPLICATIONS

This application is a 371 U.S. National Phase Entry of PCT/GB2015/051481, international filing date May 20, 2015, which claims priority to GB1408960.1, filed May 20, 2014, the contents of which are hereby incorporated by reference in their entirety.

This invention relates to a steam cycle power module. In particular, but not exclusively, the invention relates to such a module arranged to receive a supply of steam, generate energy, particularly electricity therefrom and further to output water.

In a steam cycle, high pressure, high temperature steam is delivered from a boiler(s) to a steam turbine generator (STG), expanded through the turbine generating power and condensed back to water in either a water or air cooled condenser, to be recycled back to the boiler. To provide this cycle a multitude of additional equipment is required, such as cooling fans, deaerators, feedwater pumps, condensate pumps, cooling water pumps, vacuum pumps, make up water pumps, condensate tanks, blowdown tanks, Pressure Reducing and Desuperheating Systems (PRDS), various heat exchangers, water treatment plant, chemical dosing system, motor control centres, Programmable Logic Controller (PLC) control system, piping, valves, instrumentation etc., which is usually referred to collectively as Balance of Plant (BoP).

Traditionally the equipment is treated individually, with a free-standing air cooled condenser or cooling water cooler, separate steam turbine hall, control room, motor control centre room, BoP room, free-standing external heat exchangers, free-standing deaerator etc. The layout of this equipment is usually bespoke for each plant to suit the available space resulting in a number of buildings of varying dimensions. As a result the equipment is spread out, making the interconnecting services, such as ducting, piping and cabling costly, and making the footprint of the power generation equipment large and expensive to construct as well as being individually engineered.

According to a first aspect of the invention there is provided an integrated steam cycle power module including at least some of the following features:

a) a steam turbine arranged to have steam supplied thereto;
b) a steam manifold arranged to have exhaust steam from the steam turbine supplied thereto;
c) at least one heat exchanger arranged to have exhaust steam supplied thereto from the manifold generally via risers which connect the manifold to headers associated with the heat exchangers; and
d) wherein the steam turbine is situated below the steam manifold and is arranged, in use, to exhaust exhaust steam to the manifold, which exhaust steam is passed to the heat exchanger in order to have heat extracted.

The heat is preferably extracted to condense the steam. The exhaust steam may be vented to the manifold.

According to an aspect of the invention there is provided a steam cycle power module including at least some of the following features:

a) a steam turbine arranged to have steam supplied thereto;
b) a steam manifold arranged to have exhaust steam from the steam turbine supplied thereto;

c) at least one heat exchanger arranged to have exhaust steam supplied thereto from the manifold generally via risers which connect the manifold to headers associated with the heat exchangers; and
d) wherein the steam turbine is situated below the steam manifold and is arranged, in use, to exhaust exhaust steam to the manifold, which exhaust steam is passed to the heat exchanger in order to have heat extracted therefrom, and wherein the or each heat exchanger is arranged to form a substantially planar, substantially vertical, wall along side regions of the module.

The module has a compact footprint. The footprint may be square or rectangular. Preferably the footprint and the module are arranged to be flexible in size to permit the connection of additional heat exchangers.

Thus, embodiments can integrate substantially all of the equipment required, excluding the boiler, into a single, compact module with much shorter distances for interconnecting services, thereby reducing significantly plot space, weight, overall cost, engineering, delivery time and enabling faster assembly at site. Alternatively the module may also be designed beneficially to be assembled in a workshop under more controlled conditions and transported to a land based site or shipyard (in the case of an application for an offshore installation as is the case in the Oil & Gas Industry, where the reduced plot space and weight would be an advantage.

A particular advantage of embodiments providing the first aspect is that they provide all of the equipment as a fully integrated module. Sourcing and connecting of separate items of equipment is not required. All of the equipment is integrated and the arrangement within the module can be optimised. The steam power cycle module of embodiments providing such an aspect may be provided as a "black box" ready to be connected to the steam exhaust. As such the choice and arrangement of the components are preselected for an optimal configuration with a predetermined footprint.

Desirably the module is arranged to be flexible in size to allow the connection of additional heat exchangers.

In an embodiment the or each heat exchanger is arranged to form a substantially planar, substantially vertical, wall along side regions of the module. Preferably at least one wall is formed by a heat exchanger. Desirably at least two walls, preferably side walls, are formed by one more heat exchangers. In some embodiments one or two end walls may also be formed of a heat exchanger. In a desired embodiment the module is substantially rectangular and the or each heat exchanger is arranged to form a substantially planar substantially vertical wall along the side regions of the module.

A duct may typically be provided to carry the exhaust steam from the steam turbine to the manifold, which duct connects to the manifold at substantially a central region.

Conveniently, steam is introduced in a central region of the manifold and the manifold is arranged, in use, to allow steam to move in at least two directions along the module. In alternative embodiments, the steam is introduced to at least one end region of the manifold Conveniently, the diameter of the manifold is reduced, in an axial direction, along the manifold. Such an arrangement allows the pressure of the steam within the manifold to be maintained as steam is fed from the manifold to the risers along the length of the manifold. Preferably the manifold comprise one or more truncated cones or may comprise cylinders of decreasing size on either side of the pipe from the steam turbine. Alternative means may be provided to maintain the volume of gas carried by the manifold at a constant pressure. Desirably this provides an improved distribution of steam in panels forming the heat exchanger.

Typically, the risers are provided in pairs thereby providing an arrangement which evenly balances supply of steam to heat exchangers and particularly when those heat exchangers are provided on each side of the module thereby providing two sets of heat exchangers. In some embodiments, should there be more than two sets of heat exchangers then the risers may be grouped differently. For instance, if there were six sets of heat exchangers, three on either side, then the risers may be grouped in sets of threes, etc.

Conveniently, the risers are arranged in pairs with a first riser of the pair conveying steam to a first side of the module and a second riser of the pair conveying steam to a second, different, side of the module Typically all of the Balance of Plant (BoP) equipment will be housed in the module, however some items may be housed externally if preferred. Therefore conveniently, the module comprises at least one of the following items of Balance of Plant: one or more pumps; one or more tanks, one or more deaerators; pipework; a control system; a water treatment system; an electrical distribution system; and Pressure Reducing and Desuperheating Systems (PRDS) etc.

Typically each heat exchanger comprises at least one header wherein the headers are generally arranged to have connected thereto the risers thereby joining the headers to the manifold.

There now follows by way of example only a detailed description of embodiments of the present invention with reference to the accompanying drawings in which.

Figure 1:
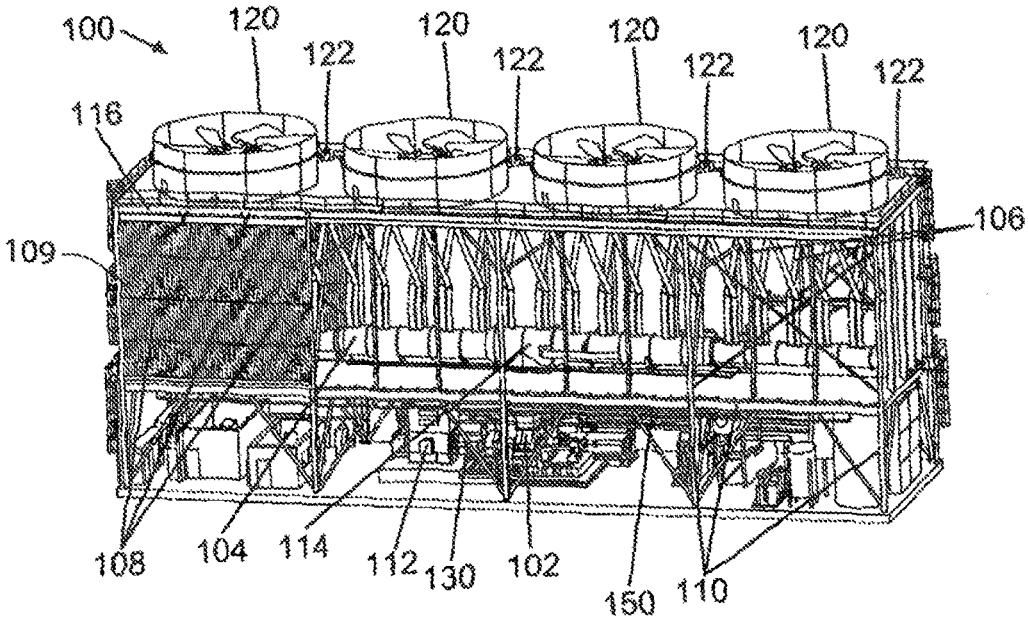
FIG. 1 shows a view of a steam cycle power module of one embodiment, with multiple heat exchanger panels removed, to show the internal equipment.
Figure 2:
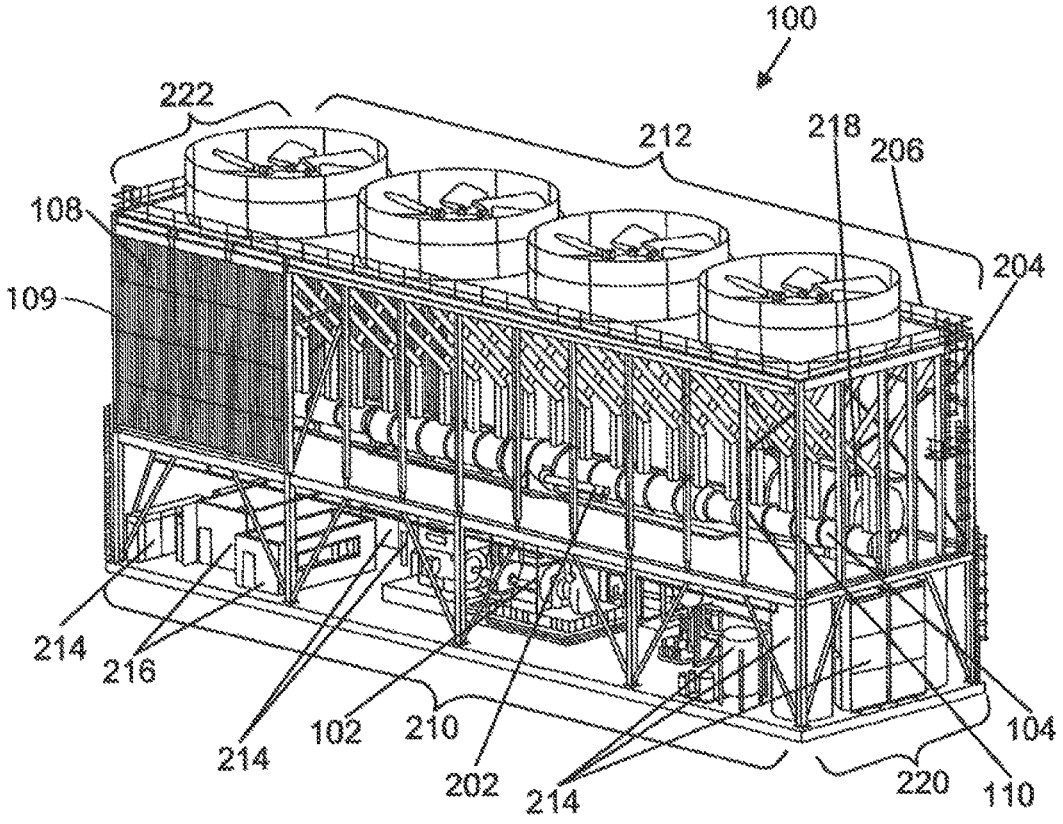
FIG. 2 shows a second view of the steam cycle power module of the same embodiment from a different angle.

FIG. 1 and FIG. 2 show a steam cycle power module 100 comprising a steam turbine 102, a steam manifold 104, risers 106, heat exchanger panels 108, condensate collection system from the headers 117 to a condensate tank 118 and condensate pumps 119 and the generator 112 and other Balance of Plant (BoP), all contained within a framework 110 of the steam cycle power module 100.

Steam is supplied to the steam turbine 102 via steam inlet pipe 550 and is exhausted from the steam turbine to the steam manifold 104 via a duct 114. The steam turbine 102 is situated below the steam manifold 104. In the embodiment being described, the turbine is directly underneath the steam manifold 104 and in a central region along the length of the steam cycle power module 100. The generator 112 is connected to the steam turbine 102 by means of a drive shaft 130 and gearbox 131.

Embodiments which provide the turbine, or at least the feed from the turbine to the central location of the manifold 104 are advantageous, due to the short distance, as they allow the steam manifold 104 to feed in two directions along the length of the module 100 after a short section of steam duct. This allows the diameter of the steam manifold 104 to be significantly reduced when compared to prior art systems which have the steam feed to the steam manifold 104 at one end of the module 100, so requiring double the pipe area (diameter increased by a factor of $\sqrt{2}$) to transport the same volume of steam per unit time. Embodiments which position the steam turbine 102 centrally are also advantageous as they allow the duct 114 to be substantially vertical and reduce the length of duct 114 whilst permitting the central feed to the steam manifold 104 discussed above.

Pipe lengths (steam manifold 104, risers 106 and header pipes 116) are reduced in this arrangement. Advantageously, this reduces both weight and materials costs.

The steam is distributed from the steam manifold 104 to a top region of the heat exchanger panels 108 via the risers 106. The risers 106 are pipes between the steam manifold 104 and header pipes 116 which run along the top edge regions of the heat exchanger panels 108 along each side 210, 212 of the module 100. In the embodiment shown, the header pipes 116 are an integrated part of the heat exchanger panels 108.

In alternative embodiments, heat exchanger panels 108 may also be present on one or both of the remaining two sides 220, 222 of the module 100 (that is at end regions thereof). In at least some of these embodiments, one or more of the risers 106 on the sections of the steam manifold 104 closest to the sides 220, 222 are angled differently from the more central risers 106 so as to deliver steam to the heat exchanger panels 108 on these sides 220, 222. In some of these embodiments, the risers 106 connecting to the heat exchanger panels 108 on sides 220, 222 have different diameters and/or lengths as compared to those connecting to the heat exchanger panels 108 on sides 210, 212. In the embodiment being described, the heat exchanger panels 108 are positioned vertically around a perimeter region of the module 100. Advantageously, this orientation facilitates construction whilst providing a large area for heat exchange with the surrounding air.

Advantageously, in the heat exchanger panels 108, the steam is cooled by the surrounding air and condenses to liquid water. The water is transported away from the steam cycle power module (also referred to as "the module") 100 via water outlet pipe 150.

In the embodiment being described, the risers 106 all have substantially the same length and diameter and are positioned in pairs along the steam manifold 104. The pairs of risers 106 are evenly spaced. The risers 106 initially extend vertically from the steam manifold 104 before being angled; one riser 106 of the pair going to one side (210 or 212) of the module 100, and the other riser 106 of the pair going to the opposite side (212 or 210) of the module 100. Along the length of the steam manifold 104, the risers 106 alternate between being connected to the header pipe 116 of one side 210 of the module 100 and the header pipe 116 of the other side 212 of the module 100.

Embodiments which provide such an arrangement of the risers 106 are advantageous as the arrangement provides a more even steam distribution across the heat exchange panels 108. In the embodiment shown, two risers 106 connect to each heat exchanger panel 108. In alternative embodiments, there is just one riser 106 per panel 108 or several risers 106 per panel 108. There could for example be 3, 4, 5, 6, or more risers per panel 108. Additionally, as shown the heat exchange panel 108 is substantially vertical. In light of this configuration, the panel 108 forms a substantially planar, substantially vertical, wall 109 along the side regions of the module.

In alternative embodiments, the risers 106 are positioned individually instead of being positioned in pairs or are positioned in a combination of pairs of risers 106 and individual risers 106.

In alternative or additional embodiments, the risers 106 are curved instead of initially rising vertically from the steam manifold 104 and then being angled. In other embodiments, the risers may simply be a substantially straight pipe directly from the manifold 104 to the header pipe 116/top region of the heat exchanger panels 108.

In alternative or additional embodiments, a riser 106 formed of a single pipe extends vertically from the steam manifold 104 and then splits into two pipes which branch to the header pipes 116 on opposite sides of the module 100.

Figure 3:
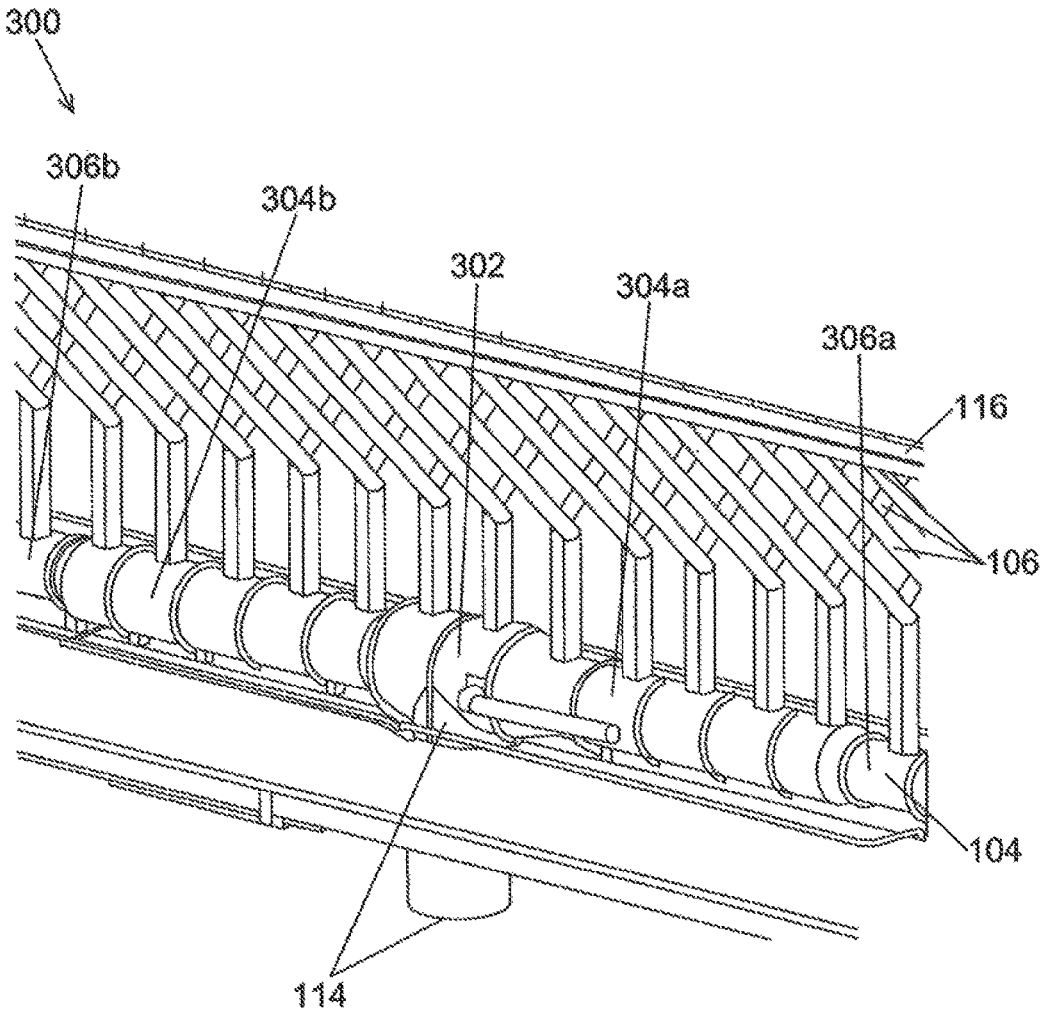
FIG. 3 shows a subsection of the embodiment shown in FIGS. 1 and 2.

FIG. 3 shows a section 300 of the steam distribution system of the embodiment being described, comprising the steam manifold 104 and risers 106, with other components of the module removed from the view.

The steam manifold 104 is composed of cylinders of varying diameters, forming a tube of varying (i.e. decreasing) diameter along the length of the module 100. In the embodiment being described, three different diameters of cylinder are used. The central cylinder 302 in the module has the largest diameter, and is the section of the manifold 104 into which steam from the steam turbine 102 is vertically exhausted into the manifold 104, via duct 114.

In at least some embodiments, including the one being described, and towards the end regions of the module 100, the steam manifold 104 diameter narrows and such an arrangement is advantageous since the volume of steam to be carried by the manifold is reduced along the manifold and the reduction of manifold diameter helps to ensure a constant pressure which in turn leads to a better distribution of steam within the heat exchange panels 108. Cylinders 304*a* and 304*b* are positioned on either side of the central cylinder 302. Cylinders 304*a* and 304*b* have the same diameter, which is less than the diameter of cylinder 302. Similarly, cylinders 306*a* and 306*b* are positioned on the outer ends of cylinders 304*a* and 304*b*, respectively. Cylinders 306*a* and 306*b* have the same diameter, which is less than the diameter of cylinders 304*a* and 304*b*.

In alternative embodiments, more or fewer different diameters are used. In still further alternatives, the steam manifold 104 comprises two cones, or truncated cones, with the widest planar faces joining in a central region of the module, where duct 114 connects to the steam manifold 104 or is otherwise tapered away from the widest central section.

In alternative or additional embodiments, the steam manifold 104 is an extension of the steam duct 114 from the steam turbine 102. The steam manifold 104 takes any convenient shape as would be understood by the person skilled in the art, with the risers 106 connecting to header pipes 116 in any convenient direction, angle etc.

In the embodiment being described, the module 100 has a rectangular footprint. The steam manifold 104 is parallel to the longer sides of the rectangle and equidistant from each. In an alternative embodiment which is square, a pair of opposite sides are selected as the sides to which the steam manifold is parallel. In alternative embodiments, the steam manifold 104 is positioned in a central region of the module without being precisely equidistant from the selected pair of sides.

In the embodiment being described, four fans 120 are provided on the top surface of the module 100. Advantageously, the fans 120 increase air movement and improve air circulation, so improving cooling. In other embodiments, more or fewer fans 120 are provided. The fans 120 are driven by fan drive motors 122. In the present embodiment, each fan 120 is driven by a corresponding fan drive motor 122.

In the embodiment being described, ladders 204 and a railing 206 are provided, attached to the framework 110 of the module 100. The ladders 204 provide access to the higher sections of the module 100. The railing 206 is provided for safety. In alternative embodiments, no ladders or railing are included. In still further embodiments, additional ladders 204 and/or railings 206 are provided.

Additionally, various balance of plant components 214 are contained within the framework 110 of the module 100. The balance of plant includes one or more of the following components:

- one or more steam turbine generator and auxiliary equipment;
- one or more pumps;
- one or more tanks;
- one or more pressure vessels;
- one or more deaerator 218;
- one or more valves;
- one or more instruments;
- pipework and support structures;
- a control system;
- a water treatment system;
- an electrical distribution system;
- a control room with PLC;
- a motor control room;
- one or more motor control panel;
- Steam turbine bypass system including Pressure Reducing and Desuperheating Systems (PRDS) 202;
- one or more heat exchangers;
- one or more cooling water systems;
- one or more steam manifold;
- one or more steam risers, and
- one or more fans.

Advantageously, the incorporation of balance of plant 214 into the module reduces the lengths of piping needed between system components and reduces the total footprint of the system.

In the present embodiment, a Pressure Reducing and Desuperheating System (PRDS) 202 is provided from the central section 302 of the steam manifold 104. This can be mounted in the space between the heat exchanger panels in the upper module region, providing adequate NPSH (Net Positive Suction Head) for the feed water pumps mounted at the lower level. This deaerator is used to control the high pressures and temperatures associated with steam power generation allowing any excess steam to be condensed, or alternatively to bypass the steam turbine generator (112).

Figure 5A:
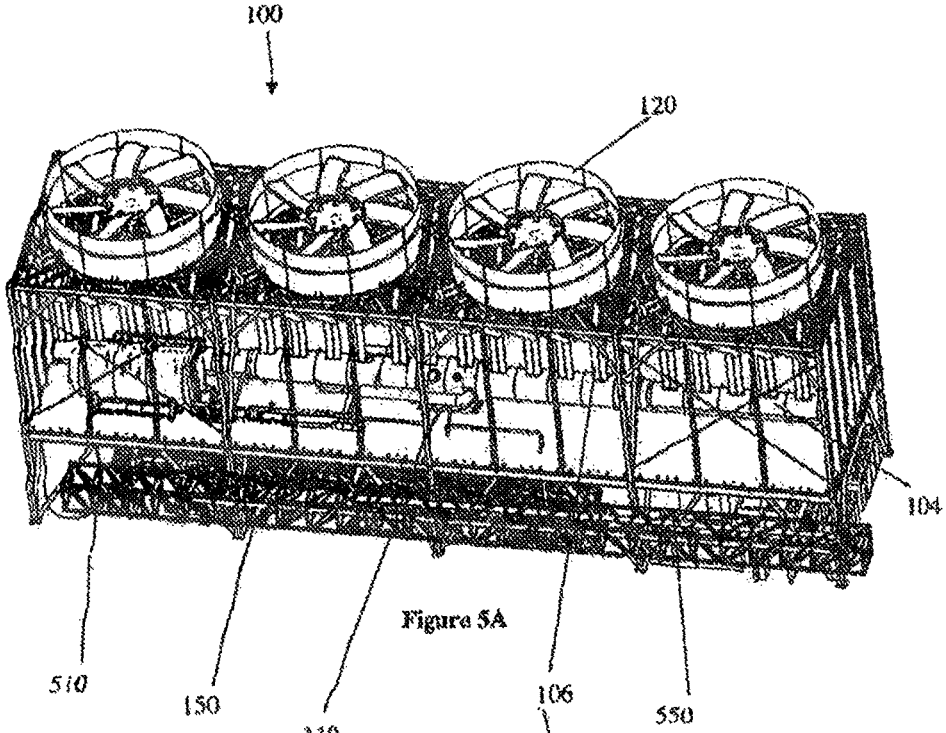
FIG. 5A shows a view of the other side of the steam cycle power module of the same embodiment.
Figure 5B:
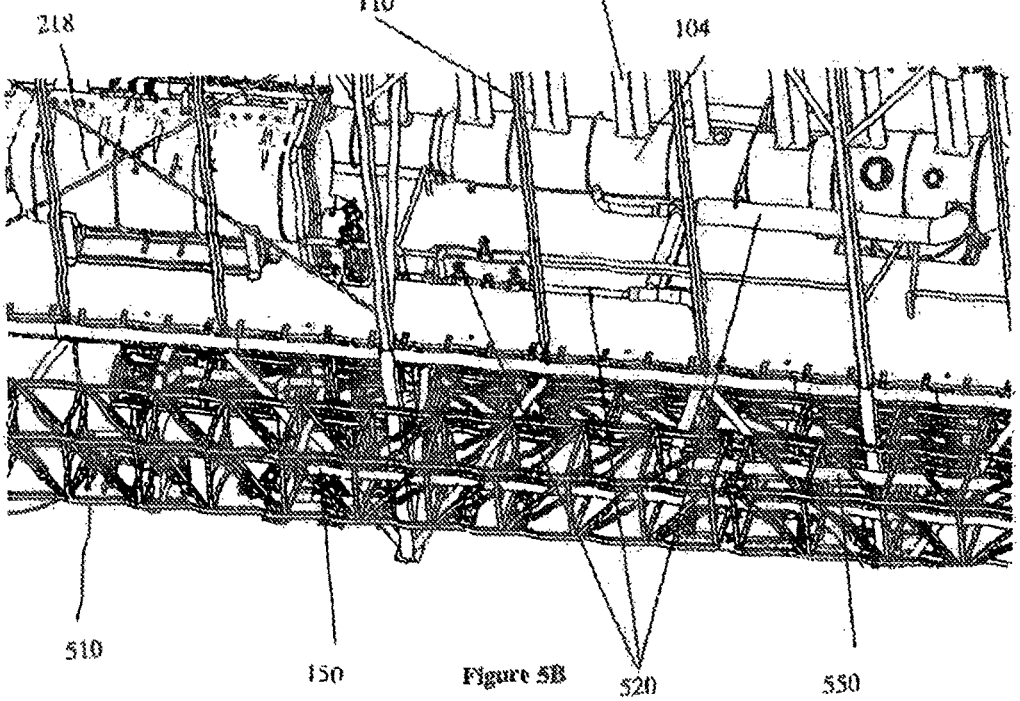
FIG. 5B shows a subsection of the view provided by FIG. 5A.

In the present embodiment, a deaerator 218 is also provided. Advantageously, this reduces corrosion damage to the system by removing oxygen and other gases which have dissolved into the water used as a feed for the module 100. Preferably, low pressure steam obtained from an extraction point in the steam turbine 102 is used to deaerate the water delivered to the deaerator 218 through piping system 521. The connecting pipes and valves 520 which link the deaerator 218 to the steam supply 521 in the embodiment being described are shown in FIGS. 5A and 5B. Steam directly from the steam inlet pipe 550 may also be used in this process.

In addition, a control room and a motor control centre room 216 are incorporated into the module 100 of the present embodiment. Advantageously, this provides the working space required and obviates the need for dedicated rooms elsewhere. In alternative embodiments, the floorspace within the footprint of the module 100 is not divided into separate rooms or sections, or is divided into a different number of rooms or sections. In yet further embodiments, control equipment may be provided externally of the module.

Figure 4:
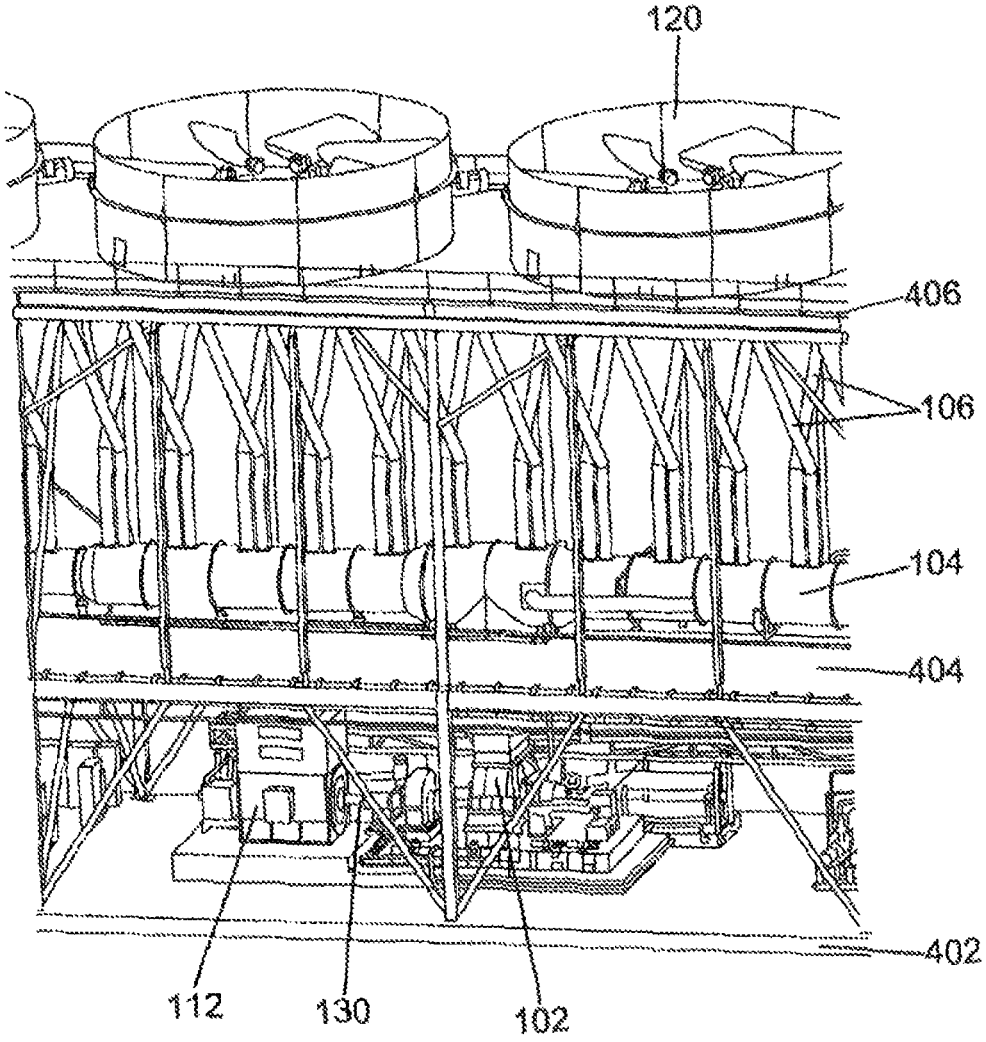
FIG. 4 shows a different subsection of the embodiment shown in the above Figures.

As shown in FIG. 4, the embodiment being described has three platforms 402, 404, 406. Advantageously, all platforms 402, 404, 406 of the steam cycle power module 100 can be accessed by means of ladders 204 to facilitate construction, maintenance and oversight. In alternative or additional embodiments, there are additional platforms of the module 100 above, below or between the platforms 402, 404, 406 present in the embodiment being described. In alternative embodiments fewer platforms are provided. In alternative or additional embodiments, some or all of the platforms are not accessible.

In the embodiment being described, the lower platform 402 is open to the atmosphere on all four sides. In alternative or additional embodiments this region is enclosed with cladding to form a weather-tight enclosure. The cladding may also include acoustic surfaces to minimise noise break out.

Platform 404 shown in this embodiment is of substantially concrete construction however other material such as steel plate may be used. Advantageously, this has the function of preventing air being drawn by the fans 120 into the region above from the region below, thereby ensuring all of the air is drawn through the heat exchanger panels 108. Advantageously the platform is watertight to prevent water ingress to the area below.

FIGS. 5A and 5B show the side 212 of the steam cycle power module 100 of the embodiment being discussed which is not visible in the previous Figures. None of the heat exchanger panels 108 are shown in this view, amongst other features which have been removed for clarity.

For simplicity, the platform 406, ladders 204 and railings 206 have also been removed from this view. In other embodiments, these features may not be present.

Two pipes 150,550 are positioned along side 212 of the steam cycle power module 100. One of the pipes 150 is visible in FIG. 1; this is the outlet for water resulting from the condensation of the steam as it cools. Conveniently, this water is then pumped back to the boiler(s). The second pipe, pipe 550, is the steam inlet to the steam cycle power module 100. This delivers steam to the module 100 from a boiler situated elsewhere. Electrical energy is generated from the steam supplied via the steam inlet pipe 550 by the steam turbine 102 and generator 112.

The water outlet pipe 150 and the steam inlet pipe 550, shown in this embodiment are supported by and enclosed in pipe gantry 510. In other embodiments, the pipes may enter/leave the module 100 at any convenient point.

The size and shape of the module 100 allow integration of the steam turbine 102 and generator 112. The design of the module 100, including various platforms 402, 404, 406 and ladders 204 advantageously facilitates the installation of the system components, including the steam manifold 104, risers 106 and fans 120.

The invention claimed is:

1. An integrated steam cycle power module comprising:

a steam turbine arranged to have high pressure high temperature steam supplied thereto;

a steam manifold arranged to have exhaust steam from the steam turbine supplied thereto;

at least one heat exchanger panel arranged to have exhaust steam supplied thereto from the manifold via risers which connect the manifold to headers associated with the heat exchangers; and wherein the steam turbine is situated below the steam manifold and is arranged, in use, to exhaust exhaust steam to the manifold, which exhaust steam is passed to the heat exchanger panel in order to have heat extracted therefrom; and wherein the or each heat exchanger panel is substantially vertical and arranged to form a substantially planar, substantially vertical, wall along side regions of the module.

2. A module according to claim 1 wherein a steam inlet pipe is provided to carry the exhaust steam from the steam turbine to the manifold, which steam inlet pipe connects to the manifold at substantially a central region of the manifold.

3. A module according to claim 2 wherein the steam inlet pipe is arranged to be substantially vertical.

4. A module according to claim 2 wherein the manifold is arranged, in use, to allow steam to move in at least two directions along the module.

5. A module according to claim 1 where the risers are provided in pairs.

6. A module according to claim 4 wherein the risers are arranged in pairs with a first riser of the pair conveying steam to a first side of the module and a second riser of the pair conveying steam to a second, different, side of the module.

7. A module according to claim 1 in which the heat exchanger panels comprise header pipes.

8. A module according to claim 7 in which the risers connect to the header pipes.

9. A module according to claim 1 wherein the module is connectable to additional heat exchanger panels.

10. A module according to claim 1 wherein each heat exchanger panel is arranged to form a substantially planar, substantially vertical, wall along side regions of the module.

11. A module according to claim 8 wherein the manifold is arranged, in use, to allow steam to move in at least two directions along the module.

12. A module according to claim 11 wherein the module is connectable to additional heat exchanger panels.

13. An integrated steam cycle, power module comprising:

a steam turbine arranged to have steam supplied thereto;

a steam manifold arranged to have exhaust steam from the steam turbine supplied thereto;

at least one heat exchanger panel arranged to have exhaust steam supplied thereto from the manifold via risers which connect the manifold to headers associated with the heat exchangers; and a steam inlet pipe connected to the manifold at a central region of the manifold to carry the exhaust steam from the steam turbine to the manifold;

wherein the steam turbine is situated below the steam manifold and is arranged, in use, to exhaust exhaust steam to the manifold, which exhaust steam is passed to the heat exchanger panel in order to have heat extracted therefrom;

wherein each heat exchanger panel is arranged to form a planar, substantially vertical, wall along side regions of the module;

wherein the steam inlet pipe is arranged to be vertical;

wherein the manifold is arranged, in use, to allow steam to move in at least two directions along the module;

wherein the risers are arranged in pairs with a first riser of the pair conveying steam to a first side of the module and a second riser of the pair conveying steam to a second, different, side of the module;

wherein the module heat exchanger panels comprise header pipes;

wherein the module risers connect to the header pipes;

wherein the module is connectable to additional heat exchanger panels; and wherein the manifold is arranged, in use, to allow steam to move in at least two directions along the module.

* * * * *